US005575496A

United States Patent [19]

Luitz et al.

[11] Patent Number: 5,575,496

[45] Date of Patent: Nov. 19, 1996

[54] COUPLING DEVICE BETWEEN A BOOT AND A PIECE OF SPORTS APPARATUS SUCH AS A SKI BINDING

[75] Inventors: Max Luitz, Blaichach-Bihlerdorf; Hans Frick, Wiggensbach, both of Germany

[73] Assignee: Atomic Austria GmbH, Altenmarkt im Pongau, Austria

[21] Appl. No.: 380,349

[22] Filed: Jan. 27, 1995

[30] Foreign Application Priority Data

Jan. 28, 1994 [AT] Austria ..... 165/94

[51] Int. Cl.[6] ..... A63C 9/00

[52] U.S. Cl. ..... 280/618; 280/617; 280/633

[58] Field of Search ..... 280/607, 611, 280/617, 618, 623, 633, 634

[56] References Cited

U.S. PATENT DOCUMENTS

| | | | |
|---|---|---|---|
| 3,913,931 | 10/1975 | Kratky | 280/633 |
| 3,943,882 | 3/1976 | Sollak et al. | 280/634 |
| 4,279,048 | 7/1981 | Bundschuh et al. | 280/633 |
| 4,444,414 | 4/1984 | Bauer et al. | 280/633 |
| 4,522,422 | 6/1985 | Jaeger | 280/607 |
| 5,056,809 | 10/1991 | Brischoux et al. | 280/633 |
| 5,085,453 | 2/1992 | Bildner | 280/633 |

FOREIGN PATENT DOCUMENTS

| | | | |
|---|---|---|---|
| 375262 | 12/1983 | Austria . | |
| 0564769 | 10/1993 | European Pat. Off. | 280/634 |
| 2617395 | 11/1977 | Germany . | |
| 3214849 | 11/1982 | Germany . | |
| 3523058 | 1/1987 | Germany . | |

*Primary Examiner*—Anne Marie Boehler
*Assistant Examiner*—Min Yu
*Attorney, Agent, or Firm*—Collard & Roe, P.C.

[57] ABSTRACT

A coupling device (3) between a boot and a piece of sports apparatus such as a ski binding having a toe clamp (1 ) and a heel clamp which are connected to each other by a connecting element at a predeterminable distance and which form a coupling device (3) which is displaceable in the longitudinal direction of the ski (5) in a guiding arrangement (9) arranged on the ski (5) and secured to the latter, and with an arresting device to secure the coupling device (3) with respect to the guiding arrangement (9) or the ski (5). Between the coupling device (3) and the guiding arrangement (9) and/or the piece of sports apparatus, an adjusting device (16) is arranged, which has a catching element (18) that can be engaged or disengaged by the actuating element (17) which is motionally connected to the latter, in or from the locking plate (19) which is provided with latching slots (20) arranged in the longitudinal direction of the ski. The catching element is pivoted in a plane running perpendicular to the longitudinal direction of the ski by means of the actuating element (17) about a swivelling axis (40) arranged either on the toe clamp (1) or the heel clamp in the longitudinal direction of the ski and approximately parallel to the surface (6) of the ski (5).

20 Claims, 6 Drawing Sheets

COUPLING DEVICE BETWEEN A BOOT AND A PIECE OF SPORTS APPARATUS SUCH AS A SKI BINDING

BACKGROUND OF THE INVENTION

1. Field of the Invention

The present invention relates to a coupling device between a boot and a piece of sports apparatus such as a ski binding.

2. The Prior Art

Coupling devices are already known which consist of a toe clamp and a heel clamp and which are connected to each other by means of a connecting element and which are conveyed in a displaceable manner in guideways in the longitudinal direction of the ski and can be interlocked in several positions by means of a catching device. In said coupling devices, the toe clamp or the heel clamp has an actuating device for the catching device whereby in many cases they require a corresponding complementary configuration of the toe clamp or heel clamp of the coupling device which is used in pairs. However, by producing corresponding workpieces, the number of the required tools is also doubled and the number of variants for repair and maintenance of the required parts is increased which is driving up considerably the costs for the parts. Moreover, differences in manufacturing techniques are possible which have a negative effect on the uniform effect of activity of the coupling device which is used in pairs.

SUMMARY OF THE INVENTION

It is now an object of the present invention to construct a coupling device in such a manner that when a catching device is used, the corresponding complementary construction is achieved with a few components, which, in addition, can be manufactured in a universal, modular way for the formation of corresponding complementary coupling devices.

This object of the invention is achieved in a ski binding comprising a toe clamp, a heel clamp, and a guiding arrangement connected to the surface of the ski and defining a guideway for the toe and heel clamps for common displacement of the clamps in a longitudinal direction, by a coupling device for coupling a boot to the ski binding, which coupling device comprises a device for retaining a selected one of the clamps in an adjusted position in the longitudinal direction, the adjusting device including an actuating element, a catching element connected with the actuating element, the actuating element with the catching element being pivotal in a plane extending perpendicularly to the longitudinal direction about a swivel axis extending substantially parallel to the longitudinal direction and to the surface of the sports apparatus, and a locking plate extending in the longitudinal direction and defining a series of latching slots spaced from each other in said direction, the catching element engaging a respective one of the latching slots when the actuating element is pivoted into a retaining position. The adjusting device further comprises an attachment part superimposed on the housing part, the actuating element with the catching element being pivotally connected to the attachment part by the swivel axis, and the attachment part with the actuating element being approximately U-shaped and encompassing the housing part in the direction of the surface. Thereby, the surprising advantage lies in that by using a catching element which is pivotal in a plane running perpendicular to the longitudinal direction of the ski with a locking plate running in the longitudinal direction of the ski, a mechanical module can be achieved which can be offset selectively by 180° in a housing of the toe clamp or the heel clamp and which has an actuating device with a swivel pin for the locking element, and moreover consists of identical parts.

However, another object of the invention is also possible because thereby a division into structural components is achieved which permits a simple and cost-effective pre-assembly and thereby also simpler and failure-proof components.

A further object of the invention is also advantageous because thereby control and maintainance work and also the exchange of complete components can be easily carried out.

Another object of the invention is advantageous because thereby the attachment part can be mounted on the housing part of the coupling device in any way possible in a position pivoted each time about 180° with respect to the longitudinal direction.

But another object of the invention is also advantageous because no special tools are required for the assembly or the exchange of the attachment part in case of damage.

A further object of the invention is also possible because thereby high holding forces between the components are achieved.

A further development is advantageous because expensive tools and additional assembly costs can be saved.

Furthermore, another object of the invention is advantageous because thereby it is easier to construct processing tools and to use different materials for the components.

However, a further object of the invention is also possible because thereby a stable drag bearing arrangement is achieved for the actuating element and the locking forces are taken up directly from the housing part with the result that there is a simple connection device between the attachement part and the part of the body.

According to a preferable other object of the invention additional components, such as spindles, etc. are avoided.

By a further advantageous development a protected, covered arrangement of the swivel pin is achieved which provides for great protection against damages.

But another object of the invention is also advantageous because thereby disturbance-proof components can be achieved.

Another object of the invention is advantageous because thereby the guiding arrangement for a complementary use in both, the left and the right embodiment of the coupling device can be used likewise.

However, another object of the invention is also possible because thereby a self-centering during the locking process or respectively a problem-free engaging of the catching element can take place.

By an advantageous further development strong coupling forces can be achieved in a locked position between the catching element and the guiding arrangement or respectively the locking plate.

An advantageous further development makes it possible that the release values of the release binding can be seen by the user from the elements of the housing part.

However, another object of the invention is also advantageous because thereby an automatic latching of the catching elements into the slots can be achieved when the coupling device is adjusted.

According to an advantageous further development a safety locking is achieved which prevents unintentional unlocking.

Thereby, another object of the invention is also possible because series elements at favourable cost can be used for the spring device.

Finally, an advantageous further development is advantageous because thereby a favourable flow course of the coupling device is achieved and projections which are a risk to safety are avoided and the locking forces are transferred to the housing part for the relieve of the connection device between the attachment part and the housing part by supporting the wall section from the side or respectively the actuating element in the recess.

BRIEF DESCRIPTION OF THE DRAWINGS

For a better understanding of the invention, it is explained hereinafter in further detail, by way of example only, of the accompanying drawings, in which.

DETAILED DESCRIPTION OF PREFERRED EMBODIMENTS

Figure 1:
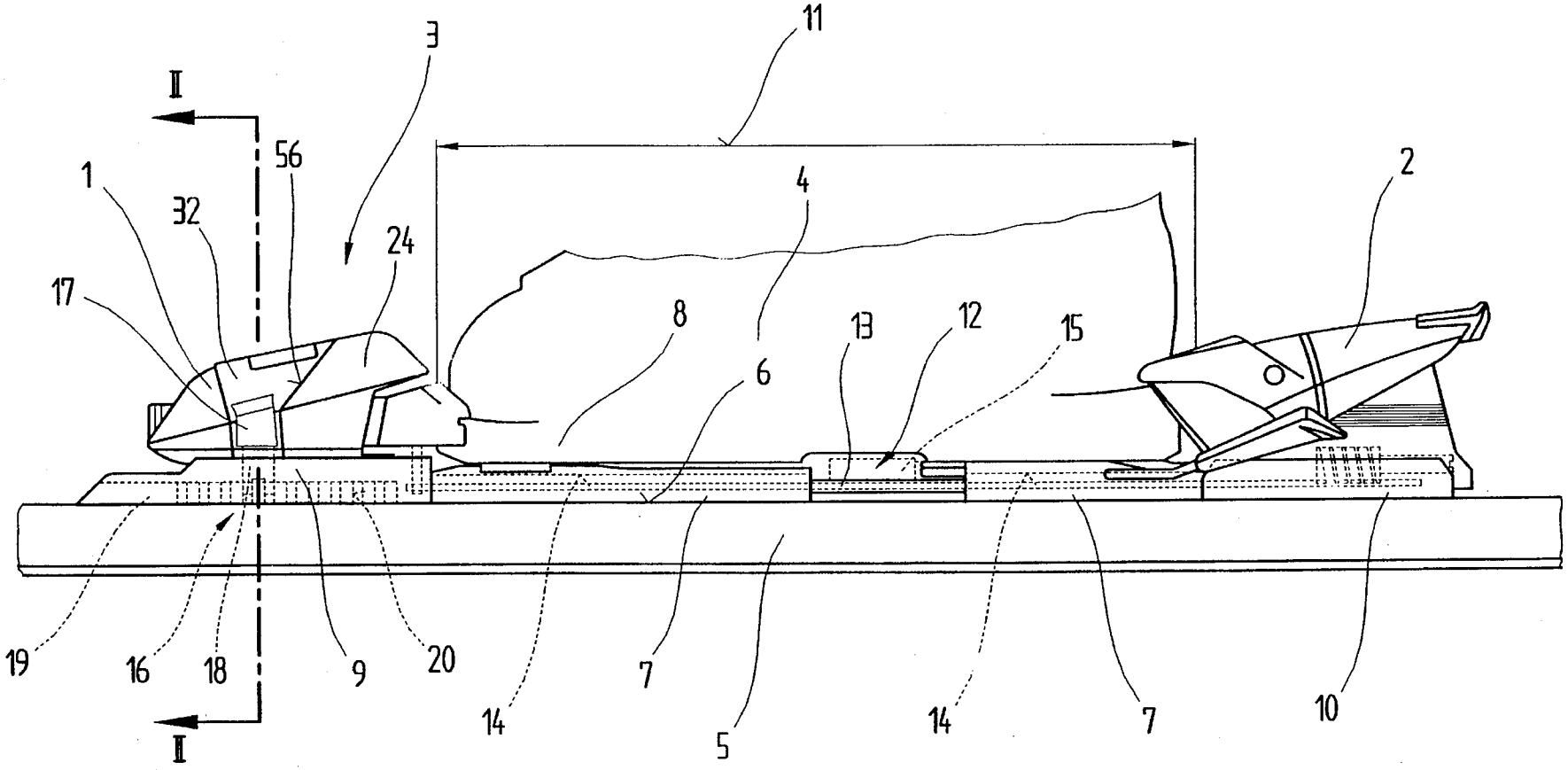
FIG. 1 is a view of a coupling device in accordance with the invention with the adjusting device.

FIG. 1 shows a coupling device 3 consisting of a toe clamp 1 and a heel clamp 2 for the fixing of a boot 4, in particular of a ski boot to be fixed to a piece of sports apparatus, for example a ski 5. In the region between the toe clamp 1 and the heel clamp 2, on a surface 6 of a ski 5 supporting elements 7 are arranged on which the boot 4 is supported by a sole 8.

The toe clamp 1 and the heel clamp 2 are adjustably mounted along guiding arrangements 9, 10 in the longitudinal direction of the ski 5, which are running in the longitudi0nal direction of the ski 5 and are fixed to the latter on the surface 6. A distance 11 is determined between the toe clamp 1 and the heel clamp 2 by a spacing element 12 arranged therebetween, for example a connecting strip 13, which projects beyond the supporting elements 7 in tunnel-shaped recesses 14 in the longitudinal direction of the ski. By arranging a lengthwise adjusting device 15 in the vicinity of the connecting strip 13 or respectively between the connecting strip 13 and the toe clamp 1 and/or the heel clamp 2, the distance 11 can be adapted to different boot sizes. To position the coupling device 3 with respect to the ski 5 in the longitudinal direction of the ski, the toe clamp 1 and/or the heel clamp 2 has an adjusting device 16. This way, the toe clamp 1 and/or the heel clamp 2 are fixed in a relative position with respect to the ski 5 or respectively the guiding arrangement 9, 10, whereby the other coupling part, i.e. the toe clamp 1 or respectively the heel clamp 2 can be displaced in the further guiding arrangement 9, 10 in its relative position to the ski 5 at a distance 11 which has been determined by the connection strip 13.

The tension forces caused by the toe clamp 1 and the heel clamp 2 when securing the boot 4 to the coupling device 3 are received as tensile forces by the connection strip 13, which is flexible in a direction perpendicular to the surface 6 of the ski 5 and which has a motional play in the tunnel-shaped recesses 14 with respect to the surface 6 of the ski 5. Since the tensile forces are taken up by the connection strip 13 a distortion of the ski 5 is avoided by the tension forces exerted by the toe clamp 1 and the heel clamp 2, and the elastic deformability of the ski 5 is guaranteed in the region of the coupling device 3.

Such binding devices guarantee a uniform running and guiding behaviour of the ski independently of the topographical situation and independently of the snow condition which achieves great running comfort and running safety.

By means of the adjusting device 16, the relative position of the coupling device 3 with respect to the ski 5 can be varied in the given regions in the longitudinal direction of the ski. For this purpose, the adjusting device 16 has a catching element 18 which can be adjusted by an actuating element 17 and which cooperates with a locking plate 19 arranged along the longitudinal direction of the ski, and which has latching slots 20 which are spaced apart from one another in the longitudinal direction of the ski, into which the catching element 18 engages when the coupling device 3 is fixed.

By unlocking the catching element 18, for example by means of the actuating element 17, the coupling device 3 can be displaced in the longitudinal direction of the ski and thereby can be positioned into different positions along the longitudinal direction of the ski by matching the latching slots 20.

Since the position of the boot relative to the longitudinal direction of the ski is very important, for example at a different distance from the front end of the ski, for the running comfort at different snow conditions, such as powder snow, soft snow or hard, snow, the adjustability of the coupling device 3 is a predominant improvement when the ski is used universally.

Figure 2:
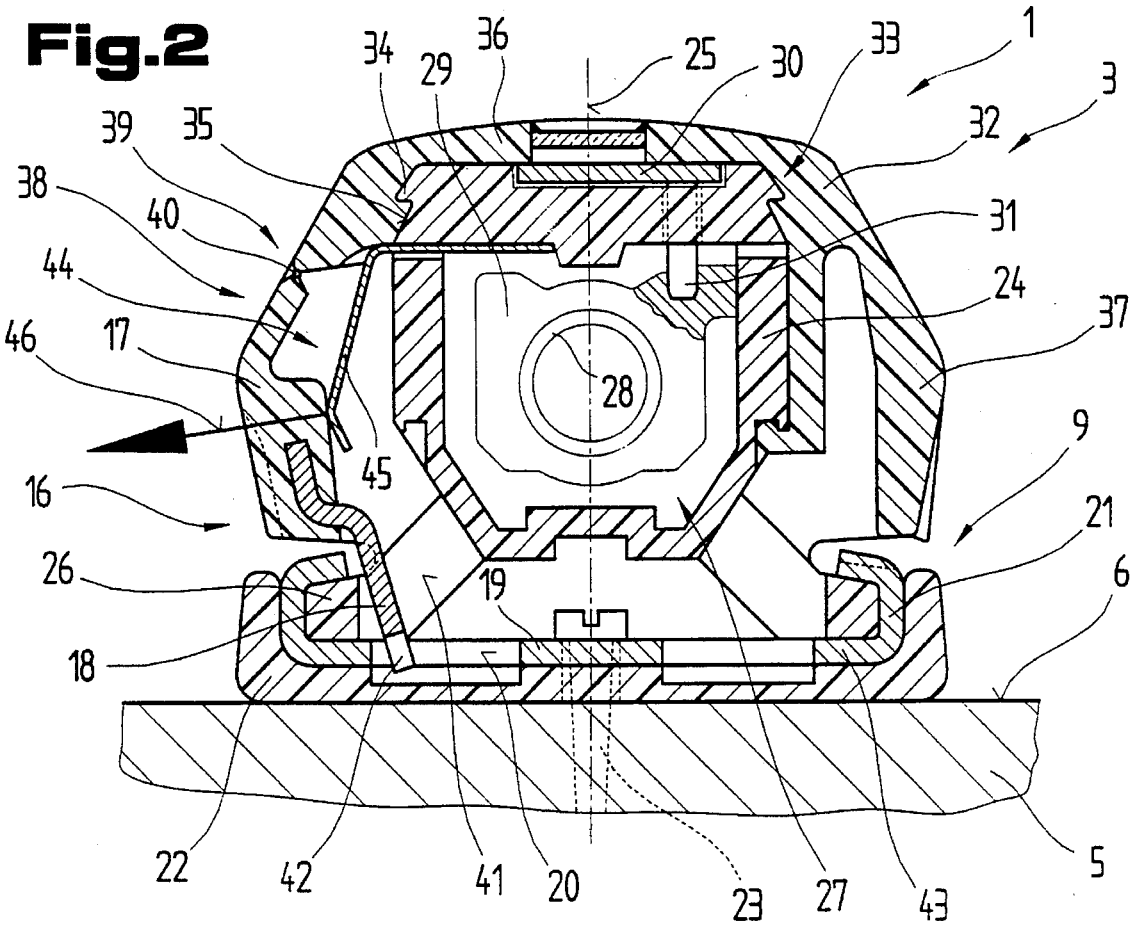
FIG. 2 shows the coupling device with the adjusting device in a locked position, in a section taken along the lines II—II in FIG. 1.
Figure 3:
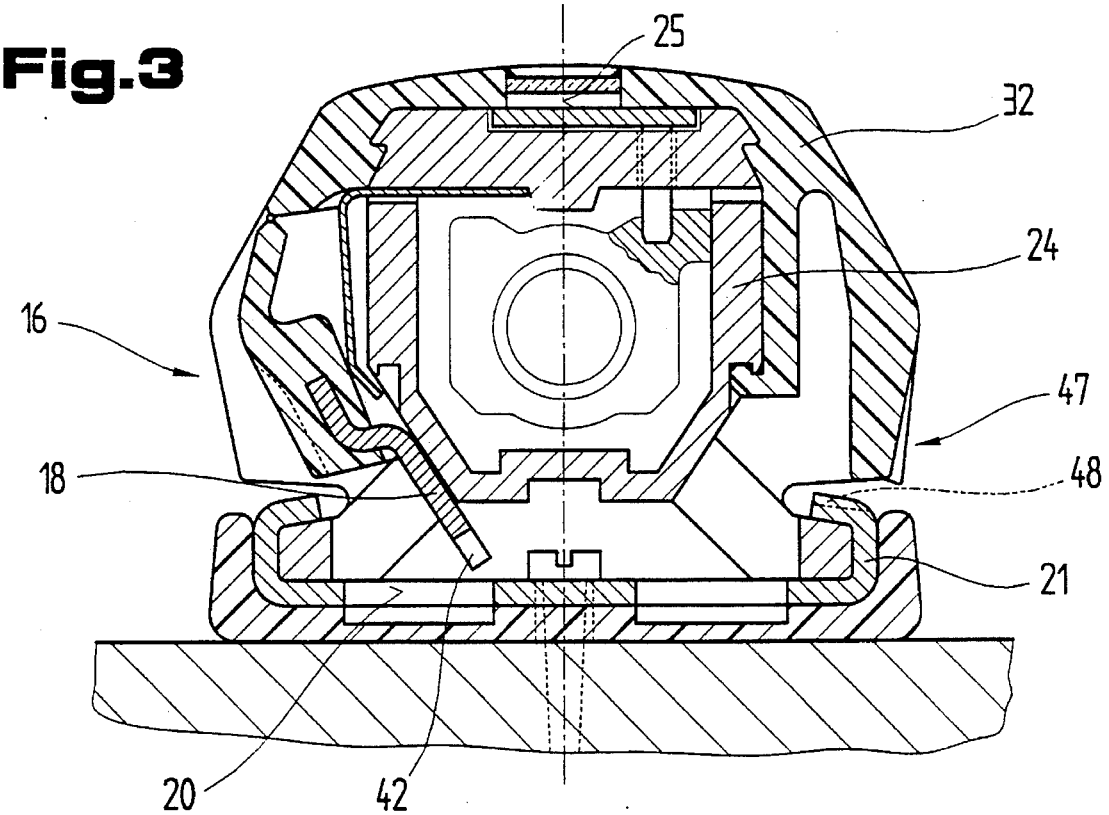
FIG. 3 shows the coupling device according to FIG. 2 in an unlocked position.
Figure 4:
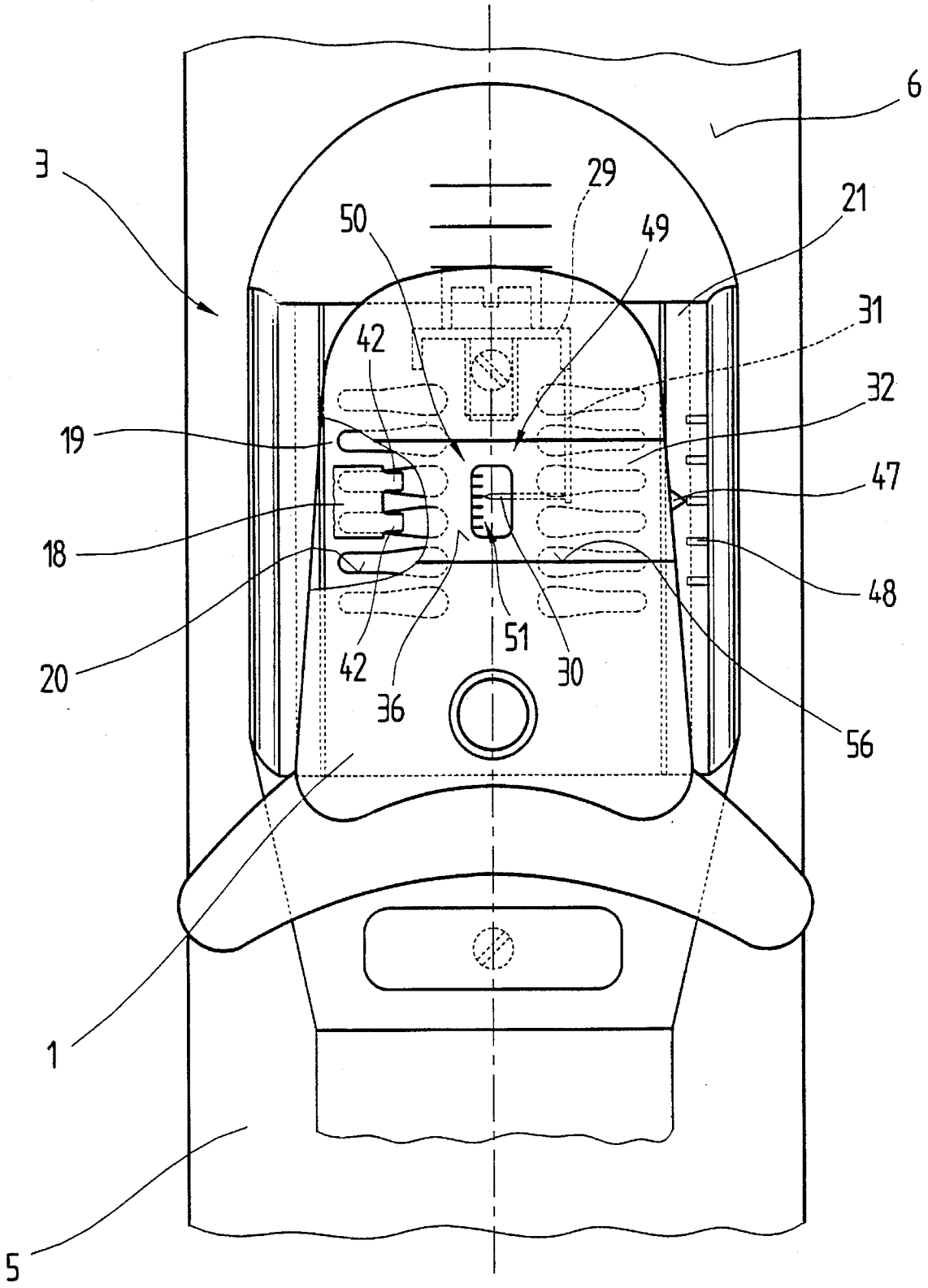
FIG. 4 is a top view, partially cut, of the coupling device according to FIG.2.

FIG. 2 to 4 show for example the adjusting device 16 which is arranged in the toe clamp 1 in a locked and in an unlocked position of the adjusting device 16. On the surface 6 of the ski 5, a guiding arrangement 9 which is formed by an approximately C-shaped profile 21 is arranged on the surface 6 of the ski 5 by using therebetween a plate-like cushioning element 22 and is fixed by means of fastening elements 23, for example screws. In this guiding arrangement 9 which forms the profile 21, a housing part 24, for example of the toe clamp 1, is guided displaceably in the longitudinal direction of the ski. For this purpose, the housing part 24 has guiding extensions 26 which are arranged in a mirror-inverted manner with respect to a plane of symmetry 25 which is running in the longitudinal direction of the ski and perpendicular to the surface 6. In an inner chamber 27 of the housing of the housing part 24, a spiral compression spring 28 is arranged by means of which the release force of the toe clamp 1 can be adjusted. Thereby, an adjustable control element 29 is acting on the spiral compression spring 28 in the longitudinal direction of the ski, by means of which the spring foce can be adjusted.

To indicate the setting of the spring force, an indicating element 30 is coupled with the control element 29 by means of a dog 31, and is positioned in the housing part 24 in a displaceable manner in the longitudinal direction of the ski.

An attachment part 32 encompasses the housing part 24 in a U-shaped manner whereby a connection device 33 causes a detachable anchoring between the housing part 24 and the attachment part 32. This connection device 33 is formed by hook-shaped coupling extensions 34 which cooperate with corresponding complementary recesses 35 of the attachment part 32 and which are formed on to the housing part 24 in a mirror-inverted manner with respect to the plane of symmetry 25.

The attachment part 32 which surrounds the housing part 24 in a U-shaped manner is formed by a cross-piece 36 which covers the housing part 24 on the sides of the latter facing away from the surface 6 and by shanks 37 which surround the housing part 24 laterally, whereby a wall section 38 forms the actuating element 17 in one of the shanks 37, and which is connected in one piece in a pivotal manner with the attachment part 32 over a weakened section 39, which forms a so-called strap hinge and thereby a swivelling axis 40 for the wall section 38. Thereby, the swivelling axis 40 runs approximately parallel to the surface 6 of the ski 5 and the plane of symmetry 25, which causes the pivoting of the wall section 38 or the actuating element 17 to take place in a plane perpendicular to the surface 6 and the plane of symmetry 25.

Connected immovably to the pivotal actuating element 17 is the catching element 18 which extends in the region of a perforation 41 of the guiding extensions 26 in the direction of a surface 6 and engages by means of a catching claw 42 in the latching slots 20 in a locked position. The latching slots 20 are thereby arranged in a profile 21 forming the guiding arrangement 9 and spaced apart from one another in the longitudinal direction of the ski in a cross-piece 43 facing towards the surface 6, whereby with respect to the plane of symmetry 25 the latching slots 20 situated in the cross-piece 43 are arranged in a mirror-inverted manner to one another. Thereby, it is possible in connection with the mirror-inverted construction of the connection device 33 between the attachment part 32 and the housing part 24, to arrange the attachment part 32 with respect to the longitudinal extension of the ski 5 selectively into two positions which are pivotal to one another around 180°, in order to form the toe clamp 1 corresponding complementary, for example for a left and a right embodiment. Thereby, only identical parts are used which results in a particularly cost-effective production of a coupling device 3 with an adjustment device 16.

A spring device 44 acting on the wall section 38 is provided, which cooperates with the actuating element 17 in order to hold the latter respectively the catching element 18 in a safe and locked position, which for example consists of a leaf spring 45 and exerts a spring force on the latter—according to arrow 46—, which must be overcome to unlock the catching element 18 which is engaged in the latching slot 20. By applying such a counter-force to the actuating element 17, the unlocked position is created, as can be seen from FIG. 3, whereby the catching element 18 or respectively its catching claw 42 is pivoted in the direction of the plane of the symmetry 25 and gets out of the region of the latching slots 20. Now, a displacement of the housing part 24 with the attachment part 32 in the longitudinal direction of the ski is made possible into the region of other adjacent latching slots in the longitudinal direction of the ski.

By means of a marking 47 arranged on the attachment part 32 for example, opposite of which a counter-marking 48, for example on the profile 21 is arranged, a problem-free detection of the latching slots 20 is possible when adjusting the coupling device 3 or respectively the toe clamp 1 in the longitudinal direction of the ski. Of course, such auxiliary measures can also be achieved by other embodiments for a problem-free locking.

As it can be seen better from FIG. 4, the catching element 18 has two catching claws 42 which engage in latching slots 20 being adjacent to one another in order to achieve better locking forces. To facilitate the locking of the catching element 18 with the locking plate 19 or respectively the engagement of the catching claws 42 into the latching slots 20, the latching slots 20 extend in a tapered manner in the longitudinal direction. This results in leading-in inclinations for the catching claw 42 which makes it possible to find the position in a reliable manner.

Moreover, the adjustment of the release force can be seen from the embodiment of an indicating device 49, which is provided with a viewing element 50 in the cross-piece 36 of the attachment part 32, through which the position of the indicating element 30 can be seen, whereby said indicating element is motionally connected with the control element 29 by means of the dog 31 and opposite of which a fixed dial 51 is arranged.

To find the positions when adjusting the coupling device 3 the surface 6 of the ski 5 has markings 47, for example in the region of the front edge of the coupling device 3. These markings can be different in colour but may also show the respective position which has been set by numerical markings.

Figure 5:
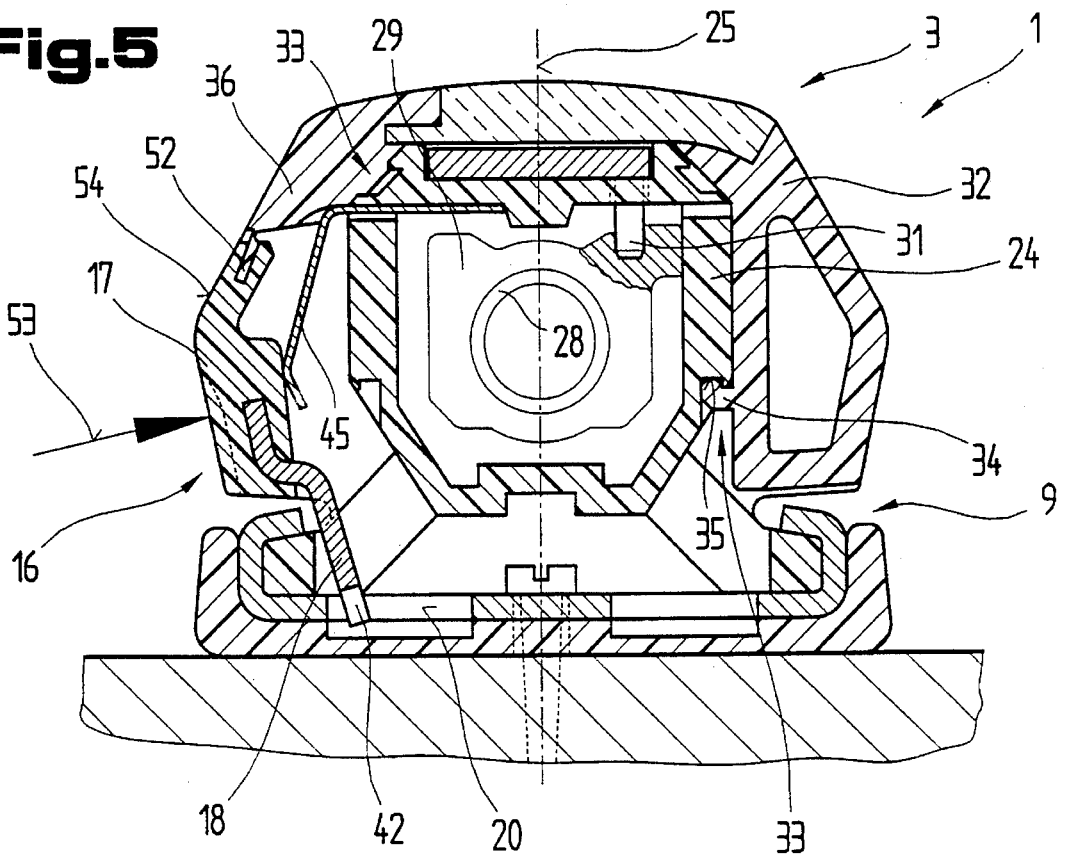
FIG. 5 is a view of another embodiment of the coupling device with the adjusting device in a locked position, in section.
Figure 6:
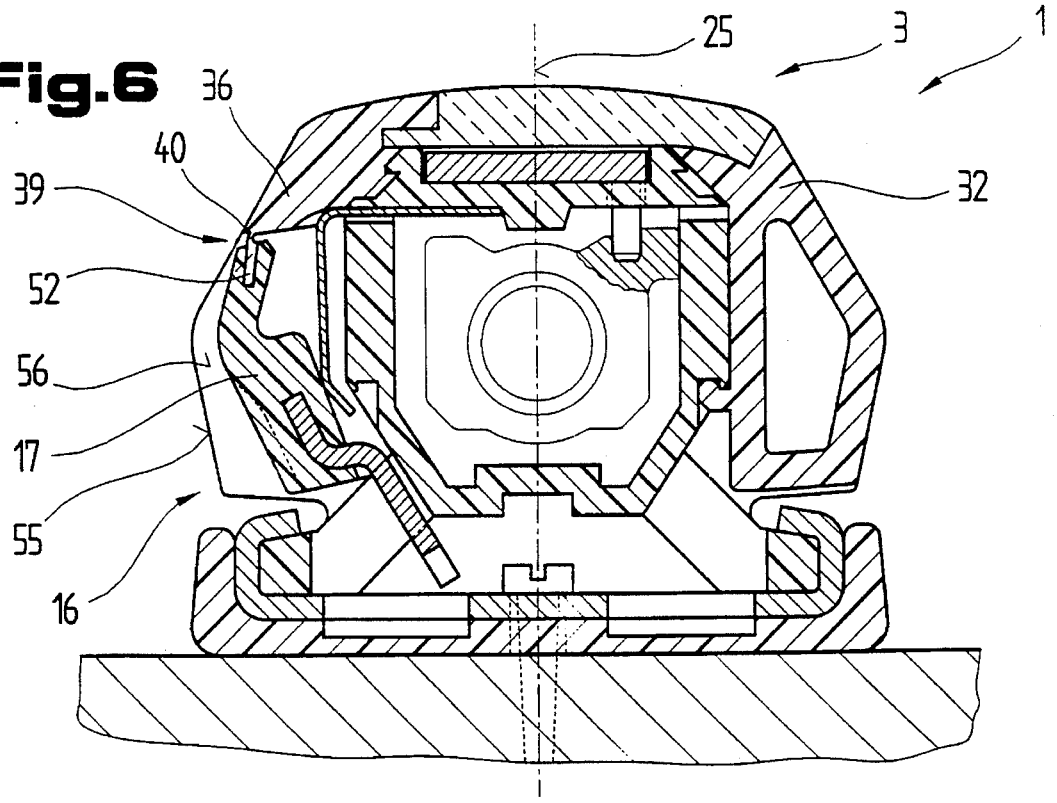
FIG. 6 is a view of the coupling device according to FIG. 5 in an unlocked position, in section.

FIGS. 5 and 6 show another embodiment of the adjusting device 16 of the coupling device 3 in a locked or respectively unlocked position. In this embodiment, the actuating element 17 which is motionally connected with the catching element 18 is pivotably connected with the cross-piece 36 of the attachment part 32 by a tab-shaped extension 52. Opposite the cross-piece 36, the tab 52 presents the weakened section 39 through which the swivelling axis 40 for the pivoting of the actuating element 17 or respectively catching element 18 is achieved in the plane which is perpendicular to the longitudinal direction of the ski.

If an actuating force which counteracts the elastic force of the leaf spring 45 is exerted on the actuating element 17 according to arrow 53 and the actuating element 17 or respectively the catching element 18 is moved into the direction of the plane of symmetry 25, the catching claws 42 come out of the region of the latching slots 20 which results in that the coupling device 3 or the toe clamp 1 and/or heel clamp 2 in the guiding arrangement 9 is unlocked and displaced.

It is apparent from the illustration in FIG. 5 and 6, that the attachment part 32 which encompasses the housing part 24 together with the actuating element 17 presents in its locked position a contour shape 54 running transversely to the longitudinal direction of the ski, which corresponds to a contour shape 55 of the housing part 24 in its regions which are adjacent to the attachment part 32. The housing part 24 has therefore in the region of the attachment part 32, a recess 56 running around in a radial direction for the reception of the attachment part 32. This way, a flow-favouring outer form is achieved which to a large extent, is very resistant against soiling by snow residues, ice, etc.

This way, the attachment part 32 is supported without play in the recess 56 with the actuating element 17 which is arranged on the cross-piece 36 in an articulated manner in the longitudinal direction of the ski. Thereby, the connecting device 33 between the attachment part 32 and the housing part 24 is relieved by the locking forces which act by means of the catching element 18 and the actuating element 17 on the attachment part 32.

Figure 7:
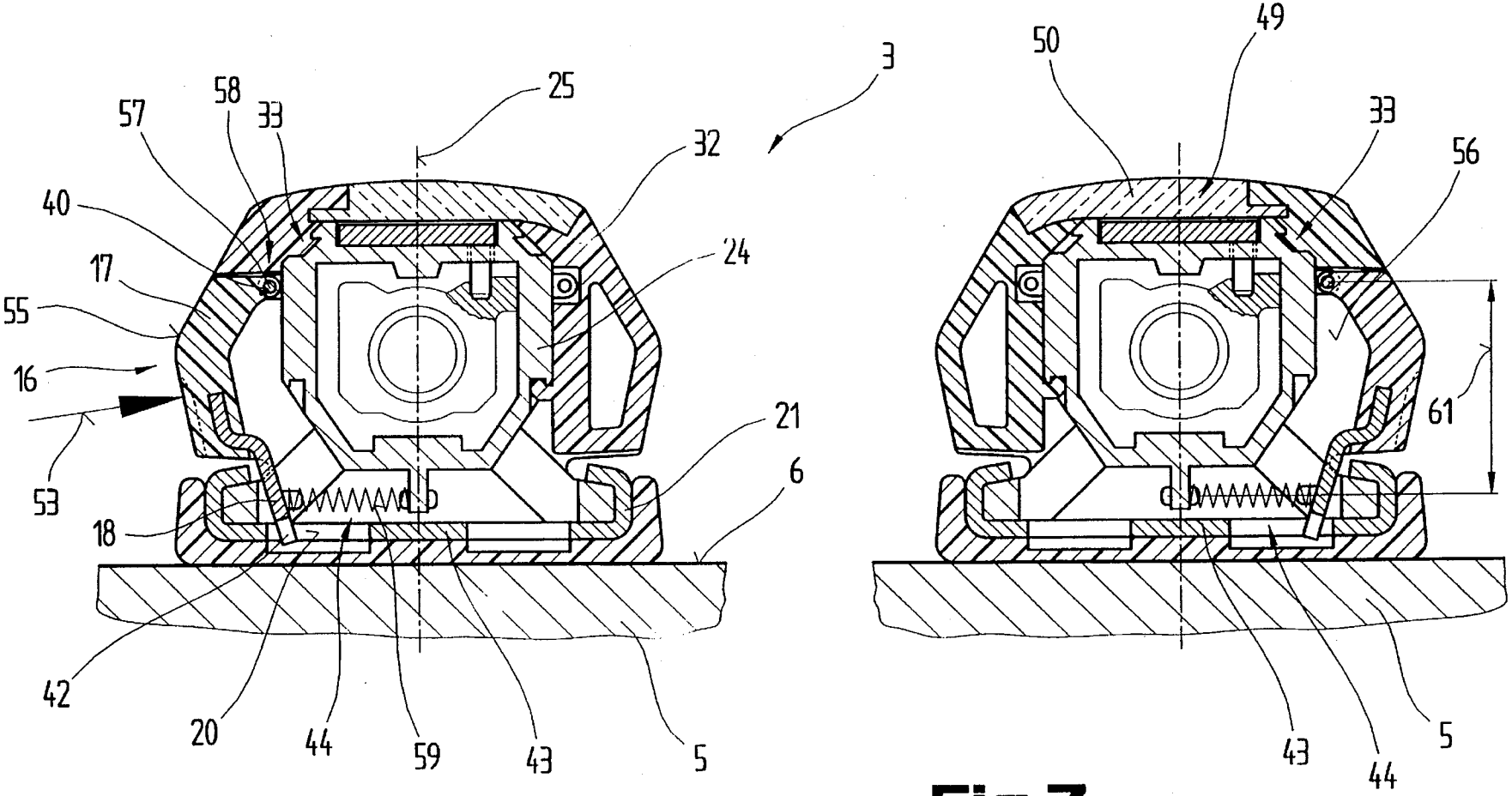
FIG. 7 is a view of another embodiment of the coupling device which can be used in pairs with the adjusting device, in section.

FIG. 7 shows a further embodiment of the coupling device 3 with the adjusting device 16 when the coupling device 3 is arranged in pairs. Thereby, the embodiment of the attachment part 32 is shown as panelling element, which is produced for example as injection moulded part in both, a left and a right, that is to say in an embodiment that corresponds complementary with respect to the plane of symmetry 25. This makes it possible to design the attachment part 32 and thereby also the housing part 24 in a styling manner since no attention must be paid to the selective use of the attachment part 32 about a position which is pivoted about 180° respective to the formation of the left and right embodiment. Thus, it is possible with such an embodiment—as can be seen already from FIG. 1—to design the surrounding recess 56 of the attachment part 32 in the housing part 24 with a curved or respectively bent course of the edges, or respectively also to adapt a tapered course of the outer contours of the toe clamp 1 or respectively of the housing part 24.

Furthermore, in this embodiment the actuating element 17 is pivotably secured by means of a drag bearing bolt 57 in a hinge arrangement 58 on the housing part 24 in the direction of the plane of symmetry 25. The drag bearing bolt 57 forms thereby the swivelling axis 40 which runs approximately parallel to the surface 6 of the ski 5 and parallel to the longitudinal extension of the ski 5. In this embodiment the spring device 44 of the actuating element 17 consists of a spiral compression spring 59 acting between the actuating element 17 or respectively the catching element 18 and the housing part 24. The spiral compression spring 59 is thereby arranged in the region between the housing part 24 and the cross-piece 43 of the profile 21 approximately parallel to the surface 6 and at a right angle to the plane of symmetry 25. With this arrangement, a distance 61 is achieved between the dynamic effect line of the spiral compression spring 59 and the swivelling axis 40, by which a high moment of torsion is achieved for which relatively low elastic forces are required in order to reliably lock the catching element 18 or respectively catching claws 42 with the latching slots 20 which are arranged in the cross-piece 43.

To displace the coupling device 3 in the longitudinal direction of the ski 5, the actuating element 17 must be activated by applying a force according to arrow 53 which counteracts the effect of the spiral compression spring 59 whereby the catching claw 42 is pivoted out of the region of the latching slot 20 which creates an unlocked position.

After an adjusting process, the problem-free locking becomes optically visible in that the actuating element 17 in the locked position of the catching element 18 assumes the outer contour shape 55 of the housing part 24 which is adjacent to the regions of the actuating element 17.

The housing part 24 is in a mirror-inverted manner with respect to the plane of symmetry 25 and concerning the precautions taken for the connecting device 33 between the attachment part 32 and the housing part 24 and also concerning the hinge arrangement 58 to the pivotal connection with the actuating element 17. This way, it is again possible to produce the housing part 24 as a uniform injection molded part and only when the coupling device 3 is assembled to adapt the latter selectively for a left and right embodiment to the actuating element 17.

The attachment part 32, which, in this embodiment, as already mentioned above, is produced in a left and right embodiment as injection moulded part, forms thereby the further covering of the recess 56 in the housing part 24 and presents also the viewing element 50 for the indicating device 49.

Figure 8:
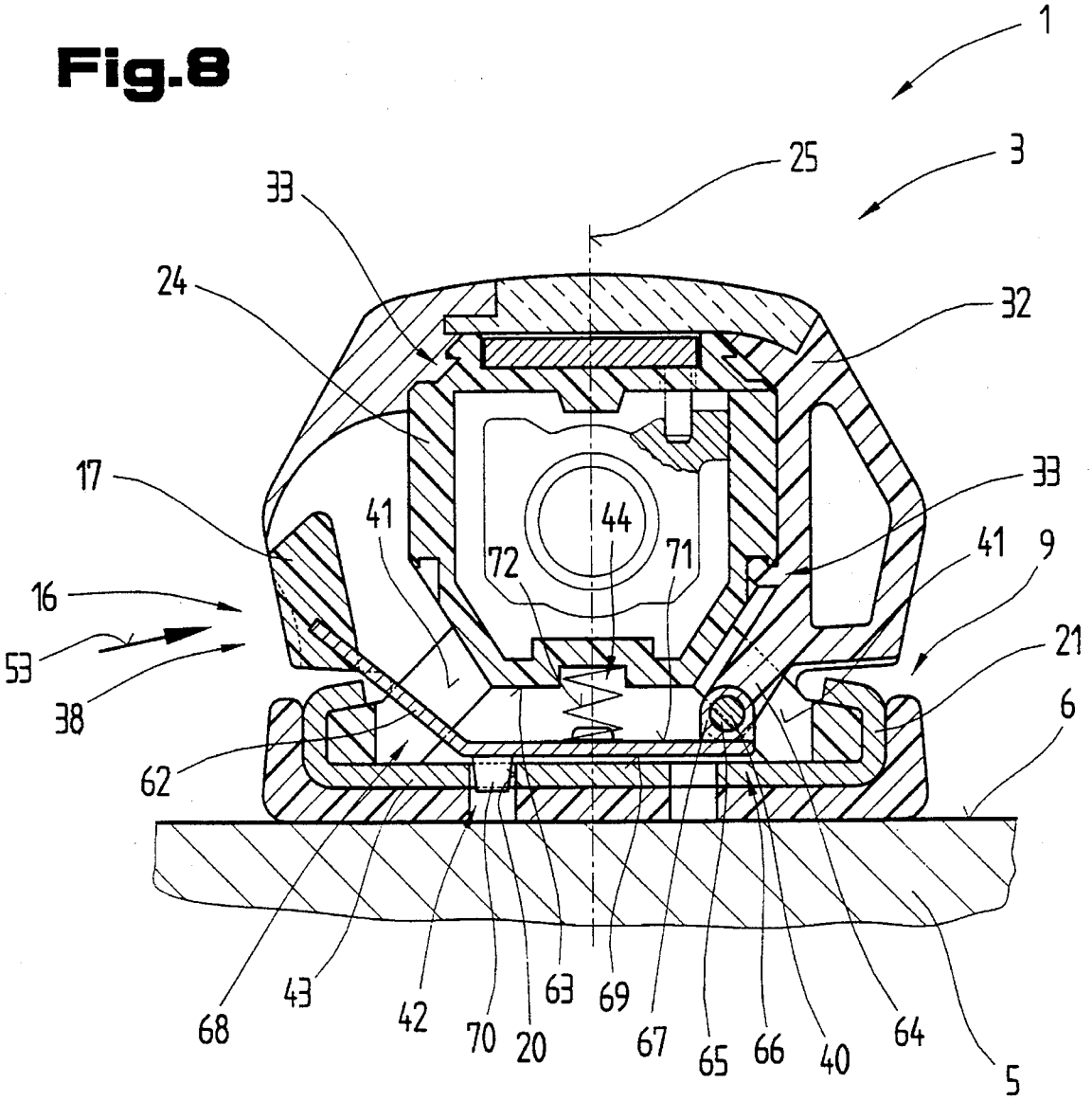
FIG. 8 is a view of a further embodiment of a coupling device with the adjusting device, in section.

FIG. 8 shows a further embodiment of the coupling device 3 with an adjusting device 16, for example on the toe clamp 1. Thereby, the attachment part 32 encompasses the housing part 24 in an approximately C-shaped manner, whereby a catching element 62 in the form of a lever which is motionally connected with the actuating element 17, runs between the profile 21 forming the guiding arrangement 9 or respectively its cross-piece 43 and along the underside 63 of the housing part 24.

The attachment part 32 is connected with the housing part 24 by the connecting device 33 which is arranged in a mirror-inverted manner with respect to the plane of symmetry 25. A bearing extension 64 of the attachment part 32 protrudes beyond the housing part 24 in the region of its perforation 41 in the direction of the proffile 21. In this bearing extension 64 is a drag bearing bolt 65, which forms the swivelling axis 40 parallel to the surface 6 of the ski 5 and parallel to the plane of symmetry 25, about which the catching element 62 is pivotal in the direction of the plane of symmetry 25. The catching element 62 forms thereby on its end 66 facing towards the bearing extension 64 a bearing eyelet 67. A marginal portion 68 of the catching element 62 is 90° offset and extends beyond the latter in a further perforation 41. In this marginal portion 68, the catching element 62 is provided with the actuating element 17 which forms the wall section 38 of the attachment part 32. On an underside 69 facing towards the cross-piece 43, the catching element 62 is provided with a catching claw 42 and with an extension 70 which cooperates tes with the latching slots 20 in the profile 21. Approximately in the region of the plane of symmetry 25 a spring device 44 is arranged between the housing part 24 and an upper side 71 of the catching element 62 which is formed by a spiral compression spring 72, said spring device causes a prestress force on the catching element 62 in the direction of the profile 21 and achieves a reliable engagement of the catching claw 42 in to the latching slot 20.

To unlock and displace the toe clamp 1, a force is required which acts upon the actuating element 17 in the direction of the arrow 53. Thereby, the catching element 62 swings round the swivelling axis 40 in the direction of the plane of symmetry 25 with the result that the catching claw 42 leaves the region of the latching slot 20 and that thereby a release is achieved to change the position of the coupling device 3 in the longitudinal direction of the ski.

Since the connecting device 33 is arranged in a mirror-inverted manner with respect to the plane of symmetry 25 between the housing part 24 and the attachment part 32, a position of the attachment part 32 with the adjusting device 16 turned selectively about 180° on the housing part 24 is made possible by this embodiment. But also in this embodiment it is possible to use left and right attachment parts 32 because of the design.

It should also be noted that for clarity of the representation, an illustration has been chosen in FIGS. 1 to 8 wherein the components are partially represented unproportionally to one another.

Only because of completeness it has to be mentioned that individual combinations of characteristics characterized in the subclaims or respectively described in the exemplary embodiments can form their own inventive solutions indpendently of the characteristics in claim 1.

More particularly, the individual embodiments in FIGS. 1, 2, 3, 4; 5, 6; 7; 8 can form the object of own solutions in accordance with the invention. Relating tasks and solutions are apparent from the detailed descriptions of these figures.

What is claimed is:

1. A coupling device for coupling a boot to a sports apparatus, which comprises (a) a toe clamp, (b) a heel clamp, (1) a selected one of the clamps comprising a housing part, (c) a guiding arrangement connected to a surface of the sports apparatus and defining a guideway for the toe and heel clamps for common displacement of the clamps in a longitudinal direction, said housing part guided in the guiding arrangement to allow an adjusted position in the longitudinal direction, (d) a device for retaining the selected clamp in an adjusted position in the longitudinal direction, the retaining device comprising an adjusting device including (1) an actuating element, (2) a catching element connected with the actuating element, the actuating element with the catching element being pivotal in a plane extending perpendicularly to the longitudinal direction about a swivel axis extending substantially parallel to the longitudinal direction and to the surface of the sports apparatus, and (3) a locking plate in the guiding arrangement extending in the longitudinal direction and defining a series of latching slots spaced from each other in said direction, the catching element engaging a respective one of the latching slots when the actuating element is pivoted into a retaining position, and (e) an attachment part superimposed on the housing part, (1) the actuating element with the catching element being pivotally connected to the attachment part by the swivel axis and the attachment part with the actuating element being approximately U-shaped and encompassing the housing part in the direction of the surface.

2. Coupling device according to claim 1, wherein between the housing part and the attachment part a connection device is arranged by which the attachment part can be coupled in a detachable manner with respect to the housing part.

3. Coupling device according to claim 2, wherein the connection device is arranged on the housing part symmetrically with respect to a plane of symmetry running in the longitudinal direction and perpendicularly to the surface.

4. Coupling device according to claim 1, wherein the connection device is formed by a snap-in connection between the attachment part and the housing part.

5. Coupling device according to of claims 1, wherein the attachment part is connected with the housing part by a screw connection.

6. Coupling device according to claims 1, wherein the attachment part and the actuating element are designed in several pieces and connected to one another in a detachable manner by a tab that is formed onto the attachement part.

7. Coupling device according to claims 1, wherein the swivel axis is formed by a weakened section in the attachment part.

8. Coupling device according to claim 1, wherein the guiding arrangement defines latching slots for the catching element arranged symmetrically with respect to a plane of symmetry extending in the longitudinal direction and perpendicularly to the surface.

9. Coupling device according to claims 8, wherein slot areas of the latching slots which are facing towards each other are flare-shaped.

10. Coupling device according to claim 8, wherein the catching element has two catching claws arranged to cooperate with two respective ones of the latching slots arranged adjacent each other in the longitudinal direction.

11. Coupling device according to claims 1, wherein the attachment part has a recess to accommodate an indicating device in a cross-piece which is facing towards an upper side of the housing part.

12. Coupling device according to claims 11, wherein a transparent viewing element is arranged in the recess.

13. Coupling device according to claim 1, wherein the actuating element is integral with the attachment part and forms a wall section thereof which is hinged to the attachment part by a weakened section.

14. Coupling device according to claim 13, comprising a further swivel axis extending substantially parallel to the longitudinal direction and to the surface of the sports apparatus for pivoting the catching element to the attachment part, the further swivel axis being arranged between the housing part and the guiding arrangement.

15. Coupling device according to claim 14, wherein the further swivel axis is formed by a pivot pin connecting the catching element to the attachment part.

16. Coupling device according to claim 1, wherein the housing part has hinges for pivotally connecting the actuating element to the housing part, the hinges being arranged symmetrically with respect to a plane of symmetry extending in the longitudinal direction and perpendicularly to the surface.

17. Coupling device according to claim 1, further comprising a spring arranged to keep the catching element in a locked position.

18. Coupling device according to claim 17, wherein the spring is a leaf spring arranged between the housing part and the actuating element.

19. Coupling device according to claim 17, wherein the spring is a spiral compression spring arranged between the housing part and the catching element.

20. Coupling device according to claim 1, wherein the guiding arrangement comprises separate guides for each clamp, the guides being spaced from each other in the longitudinal direction, and further comprising a longitudinally adjustable band-shaped connecting element connecting the toe and heel clamps to each other for common displacement along the guideway.

* * * * *